US006062158A

United States Patent [19]

Blanchard

[11] Patent Number: 6,062,158

[45] Date of Patent: May 16, 2000

[54] VESSEL MOORING DEVICE

[76] Inventor: Errol Morton Blanchard, P.O. Box 580, Rose Hill, N.C. 28458

[21] Appl. No.: 09/262,275

[22] Filed: Mar. 4, 1999

[51] Int. Cl.[7] ..... B63B 21/00

[52] U.S. Cl. ..... 114/230.27; 114/230.1

[58] Field of Search ..... 114/230.1, 230.13, 114/230.26, 230.27

[56] References Cited

U.S. PATENT DOCUMENTS

| | | | |
|---|---|---|---|
| D. 365,321 | 12/1995 | Kreeger | D12/317 |
| 3,401,413 | 9/1968 | Anselmi | 9/9 |
| 3,430,598 | 3/1969 | Soderberg | 114/230 |
| 3,486,342 | 12/1969 | Aks | 61/46 |
| 4,726,313 | 2/1988 | Neal | 114/230.13 |
| 5,265,553 | 11/1993 | Brydgs | 114/230 |
| 5,341,757 | 8/1994 | Digiacomo | 114/230 |
| 5,467,727 | 11/1995 | Godvin et al. | 114/230 |
| 5,603,280 | 2/1997 | Shackelford, Jr. | 114/230 |

*Primary Examiner*—Ed Swinehart
*Attorney, Agent, or Firm*—Mills Law Firm PLLC

[57] ABSTRACT

This invention is a simple and yet efficient device for mooring vessels that floats up and down with the tide on vertical piling which maintains both ends of a mooring line at approximately the same height from the water. This is accomplished by providing a stainless steel cage with upper and lower rings with interior diameters larger than the diameter of the piling. These rings are connected by a plurality of risers. A bail or other securing means is used to secure the end of a mooring line. A bend is provided in each of the risers near the bottom ring so that the risers project outwardly. A floating means having an interior diameter smaller than the diameter of a plane passing through the bends in the risers is slipped over the lower ring and wedges on the risers so that the mooring device can rise and fall with the tide.

5 Claims, 4 Drawing Sheets

VESSEL MOORING DEVICE

BACKGROUND OF INVENTION

1. Field of Invention

On water where vessels are moored to vertical pilings to hold them off, such vessels are subject to the influence of either surge tides, wind tide or celestial tides or a combination thereof. In low celestial tide waters you can have surge tide and wind tides and even in inland locations where there is no celestial tide, there is always the possibility of surge and wind tides.

Since mankind first floated on water, there has been a problem of tying the floating means or vessel off with enough slack to allow the same to ride up and down with the tides and yet tight enough to prevent the vessel from coming into contact with the dock or pilings. The higher the anticipated tides, the more slack is required.

The farther apart the mooring pilings, the more slack can be left in the lines for greater vertical rise and fall without contacting any adjacent structure. As the cost of waterfront property has skyrocketed, mooring spaces have been reduced to a minimum for the size boat to be moored.

Spring lines, particularly adjacent docks have been used to hold boats off. This works fairly well with celestial tide conditions but cannot withstand strong surge and wind tides.

Pulleys, slides, weights and other means have been devised in attempts to prevent the boats from contacting adjacent structures where lines cannot be slackened enough to compensate for tide rise and fall.

2. Concise Explanation of Prior Art

U.S. Design Pat. No. 365,321 to John J. Kreeger is a boat mooring line attachment system for compensating for varying tides including vertical rails with a ring slidedly mounted thereon and attached to the mooring line. This system is of limited vertical distance, thus has limited application.

U.S. Pat. No. 3,401,413 to James V. Ansellmi discloses vertical rods driven into the bottom with a float having a central opening being placed on the rods. This may be fine for small runabouts in relatively calm water, but would not work for mooring heavy vessels in strong tide areas.

U.S. Pat. No. 3,430,598 to Joseph E. Soderberg discloses poles driven into the bottom with a pot-like float having a central opening that slides over the poles. Again, this would not be adequate for larger vessels in heavy tide conditions.

U.S. Pat. No. 3,486,342 to Stanleigh W. Aks discloses a pile mooring bumper with metal hitch rings through which mooring lines are threaded with the ends being secured to the boat fore and aft.

U.S. Pat. No. 5,265,553 to Hugh B. Brydges discloses a small boat mooring system wherein the mooring line passes through a pulley with the end thereof attached to a PVC counterweight.

U.S. Pat. No. 5,341,757 to Don A. Digiacomo discloses a mooring device including vertical cables secured to pilings with pulleys mounted thereon that are attached to mooring lines.

U.S. Pat. No. 5,467,727 to Gerald B. Godvin and Charles F. Kolb, Jr. discloses a pile mooring device for boats wherein the float is tied to the ring which surrounds the piling. The mooring lines go down from the deck of the boat to the float at water level.

Finally, U.S. Pat. No. 5,603,280 to Francis H. Shackelford, Jr. discloses a boat mooring system including a track mounted on a piling with a float at the bottom thereof to move the track up and down with the tide. An eyelet is secured to the mooring line.

The above discussed prior art mooring systems are either too complicated or too expensive to be of practical use. Others are not strong enough to hold large vessels that weigh thousands of pounds, particularly in fast running tides, surge tides and heavy wind tides. Other devices would tend to bind and thus become useless and could even hold the boat down or tear the cleats out because the lines go from the deck down to the device at water level.

BRIEF DESCRIPTION OF INVENTION

After much research and study into the above mentioned problems, the present invention has been developed to provide a simple and yet high efficient means for mooring a vessel that floats up and down with the tide on vertical pilings with the mooring line at all times remaining generally horizontally disposed when taunt.

The above is accomplished by providing a vessel mooring device which includes upper and lower stainless steel rings with a plurality of rod-like risers connecting the same. A bale is mounted on the upper ring to which a mooring line is secured. A readily available float or ring buoy is inserted around the lower portion of the outwardly tapering risers which allows the mooring device to move up and down the pilings without binding as the vessel moves up and down with changing water levels. A bend in the lower portion of each of the risers retains the ring buoy adjacent the lower stainless steel ring of the mooring device.

In view of the above it is an object of the present invention to provide a relatively simple and yet highly efficient mooring device for vessels.

Another object of the present invention is to provide a highly efficient mooring device that moves up and down with the tide and can withstand the strain of mooring large vessels.

Another object of the present invention is to provide a floating mooring device that can be readily installed and removed.

Another object of the present invention is to provide a mooring device adapted to slide over vertical pilings and formed from two stainless steel rings connected by risers that engage a ring buoy-shaped float adjacent the lower ring.

Other objects and advantages of the present invention will become apparent and obvious from a study of the following description and the accompanying drawings which are merely illustrative of such invention.

DETAILED DESCRIPTION OF INVENTION

Figure 1A:
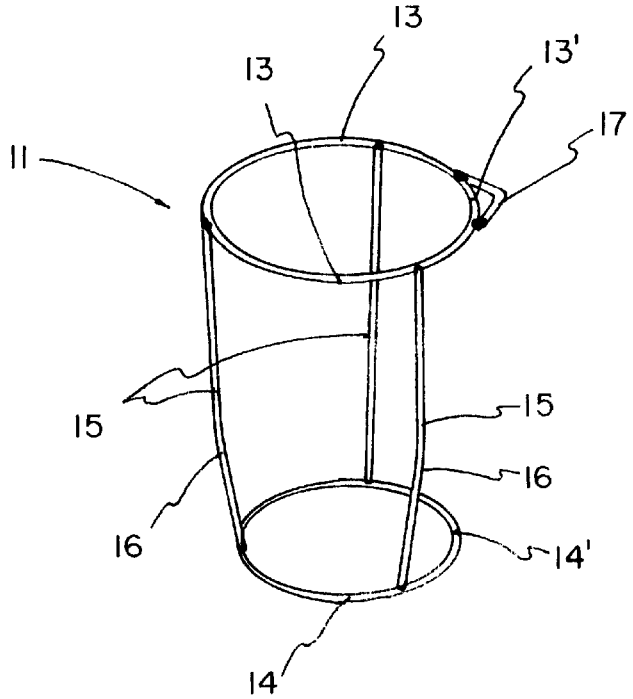
FIG. 1A is a top perspective view of the small cage vessel mooring device of the present invention.

With further reference to the drawings, the vessel mooring device of the present invention, indicated generally at 10, is composed of two parts, the cage, indicated generally at 11 and the float, indicated generally at 12.

The cage portion 11 of the present invention includes an upper ring 13 and a lower ring 14. These rings are preferably formed from ½ inch 304 solid stainless steel rod stock cut are butt welded. A plurality of risers 15 are welded between the upper ring 13 and the lower ring 14 and are made of ⅜ inch 304 solid steel rod stock. Each of these risers 15 has a bend approximately 7 inches above where they are secured to the lower ring 14. These bends are approximately 12 degrees which makes the risers bulge outwardly to engage the interior opening in the float as will hereinafter be described in greater detail.

A bail 17 for attaching a mooring line is welded to the exterior of the upper ring 13 over the butt joint weld 13'.

The top ring 13 of the small cage shown in FIG. 1A has an inside diameter of 14' inches. The interior diameter of the lower ring is 11 inches and the risers that join the rings are 18 ½" long. Although four or more risers could be used, three have been found to be completely adequate without increasing the weight and cost of the cage.

Figure 1B:
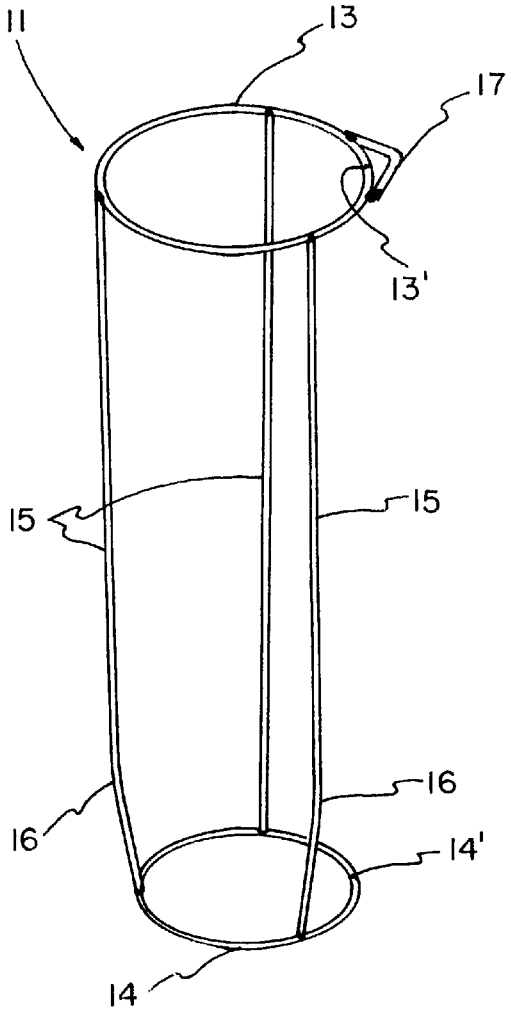
FIG. 1B is a top perspective view of the medium cage vessel mooring device of the present invention.

The medium cage 11 shown in FIG. 1B includes a top ring 13 having an inside diameter of 14 inches and a lower ring having an inside diameter of 11 inches. The risers in this cage are 36 inches long.

Figure 1C:
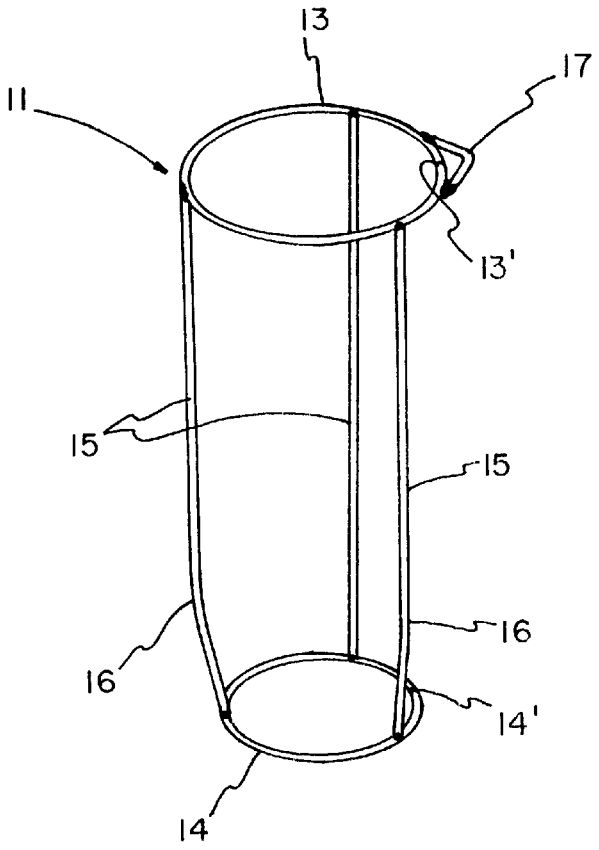
FIG. 1C is a top perspective view of the large cage vessel mooring device of the present invention.
Figure 2:
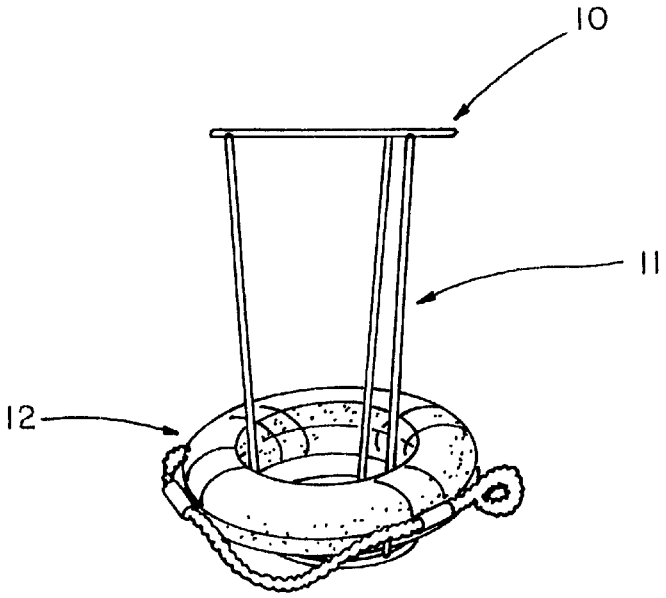
FIG. 2 is a perspective view of a large cage vessel mooring device inserted into the float and ready to install on a piling.

The large cage shown in FIG. 1C has an upper ring 13 with an inside diameter of 19 inches, a lower ring 14 with an inside diameter of 16 inches and risers of 36 inches.

Docking pilings usually come in 8, 10, and 12 inch diameters. Also the deck of boats vary in height above the water line. The small, medium and large cages described above can be used to fit the most craft 35 feet or longer.

The sizes of the rod stock used in making the rings and risers as well as the diameters of the rings and length for the risers can, of course, be made larger to accommodate larger vessels.

To use the vessel mooring device of the present invention, the cage 11 to be used is matched with a buoy or floatation means that has an interior diameter greater than the outside diameter of the lower ring 14 but less than the diameter of a plane passing through the bends 16 of the risers.

The circular float is passed over the top of the piling 19 until it floats on the water. The selected cage is then slipped over the piling and the risers wedge into the buoy. The weight of the cage pressing down and the buoy floating keeps the cage in engagement with the float and no further installation is necessary.

To remove the vessel mooring device 10 of the present invention from the piling 19, the above installation process is simply reversed with the cage being lifted over the top of the piling and usually the buoy wedged against the risers would come with the cage. If, however, the buoy does not, it can be lifted over top of the pilings separately.

Figure 3:
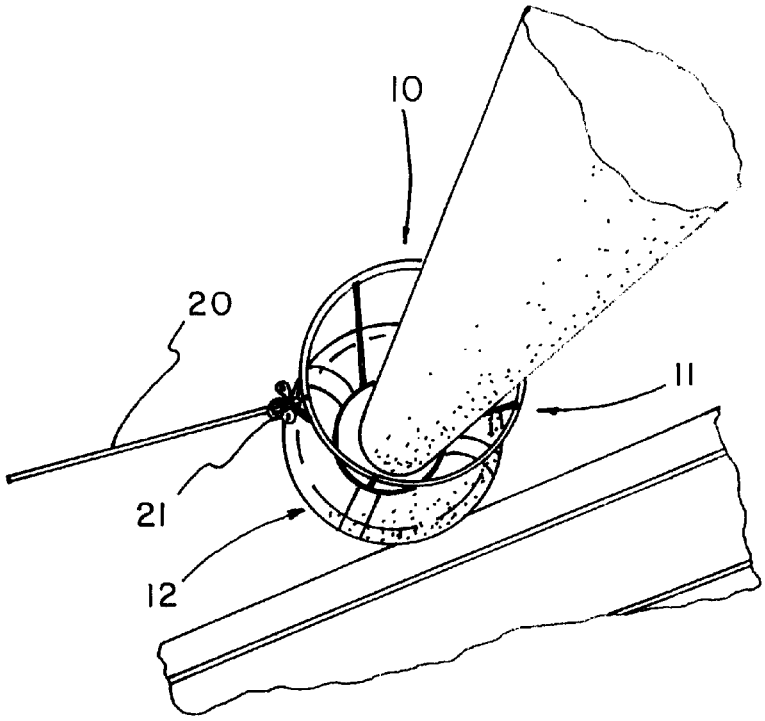
FIG. 3 is a top perspective view of the vessel mooring device of the present invention in the water and mounted on a piling with the vessel moored thereto.
Figure 4:
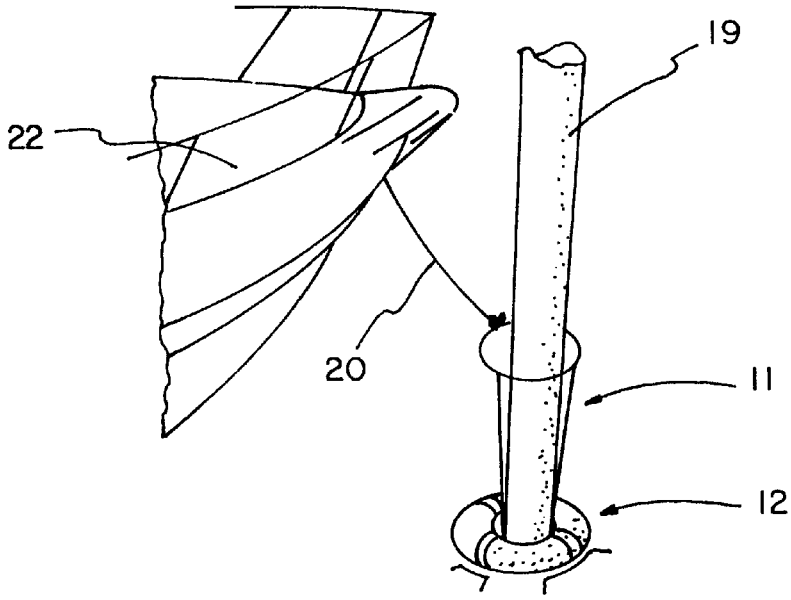
FIG. 4 is a perspective view of one of the lines from the vessel secured to the mooring device of the present invention.

Once the vessel mooring device 10 of the present invention has been mounted on the piling, as described above, a mooring line 20 can be secured to the bail 17 welded on the outer edge of the ring 13. If the mooring line has a quick disconnect snap hook on the end thereof, it can simply be hooked on the ring bail 17. If a snap hook is not used, then the mooring line can simply be tied with a knot 21 to the bail as clearly shown in FIG. 3. The end of the mooring line 20, opposite its connection to bail 17, can be cleated or otherwise secured to vessel 22 in the normal manner.

In mooring a vessel to tall pilings, it is very difficult to pull the vessel toward the piling with a boat hook. Quite often this necessitates maneuvering the boat on its own power which can be very difficult and tricky, particularly in a fast flowing water or under high wind conditions. The mooring device of the present invention stands away from the piling so that either the upper ring 13 or one of the risers 15 can be easily snared with a boat hook so that a line can be secured to the bail 17.

Figure 5:
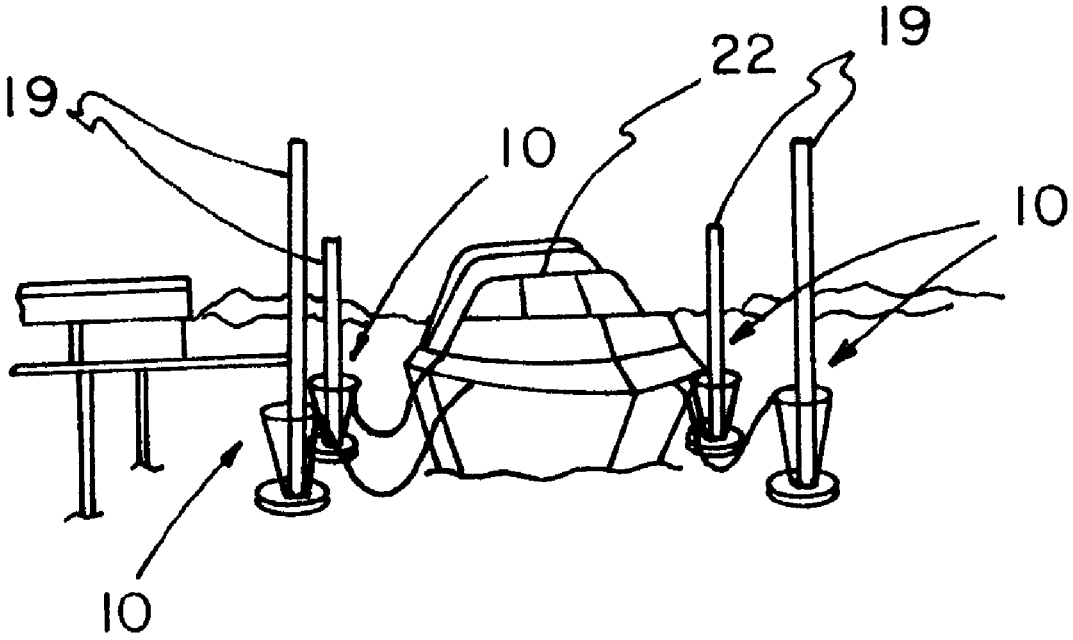
FIG. 5 is a perspective view of a vessel that is moored fore and aft to the mooring devices of the present invention.

Although on occasion a single piling can be used to bold a boat off and out of contact with other pilings, boats, docks, etc., more often at least two pilings are used to hold the boat off with other mooring lines going to dock cleats or other structures. Four pilings can be used as illustrated in FIG. 5 with each having one of the mooring devices of the present invention operatively associated therewith.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A vessel mooring device for mounting on generally vertically disposed pilings comprising:

a metal cap having upper and lower ring structures connected by elongated risers that taper outwardly in the area adjacent the lower ring; and float means mounted on the risers adjacent the lower ring whereby when the device is mounted on a piling having a diameter less than the interior diameter of the rings, it will float up and down with the tide and a vessel can be moored thereto.

2. The device of claim 1 wherein the metal cage is made of solid stainless steel rod stock.

3. The device of claim 2 wherein the metal cage is made from 304 solid steel rod stock.

4. The device of claim 1 wherein the float means has a central opening with a diameter greater than the diameter of the lower ring structure but less than the diameter of a plane passing through the outwardly tapered risers whereby the float engages the cage means to floatingly support the same.

5. The method of mooring a vessel to at least one generally vertically disposed piling comprising:

removing any nails, cleats or other obstructions from the piling;

placing a metal cage means having upper and lower ring structures joined by risers that taper outwardly in the area adjacent the lower ring slidingly over the piling and into supporting relationship with a ring float means; and securing a mooring line from the vessel to the cage whereby slackening of the mooring line is not required to compensate for the rise and fall of tides.

* * * * *